US009601875B2

(12) United States Patent
Harrer

(10) Patent No.: US 9,601,875 B2
(45) Date of Patent: Mar. 21, 2017

(54) MULTI-WIRE SHIELDED CABLE AND METHOD FOR MANUFACTURING SUCH A CABLE

(71) Applicant: MD ELEKTRONIK GmbH, Waldkraiburg (DE)

(72) Inventor: Helmut Harrer, Waldkraiburg (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 14/938,870

(22) Filed: Nov. 12, 2015

(65) Prior Publication Data

US 2016/0134061 A1 May 12, 2016

(30) Foreign Application Priority Data

Nov. 12, 2014 (EP) ..... 14003808

(51) Int. Cl.

| | |
|---|---|
| ***H01R 13/6581*** | (2011.01) |
| ***H01R 4/20*** | (2006.01) |
| ***H01R 9/03*** | (2006.01) |
| ***H01R 4/18*** | (2006.01) |
| ***H01R 43/048*** | (2006.01) |

(52) U.S. Cl.

CPC ..... *H01R 13/6581* (2013.01); *H01R 4/18* (2013.01); *H01R 4/20* (2013.01); *H01R 9/03* (2013.01); *H01R 43/048* (2013.01)

(58) Field of Classification Search

USPC ..... 439/607.55, 607.47, 98, 345; 174/84 R, 174/78

See application file for complete search history.

(56) References Cited

U.S. PATENT DOCUMENTS

| | | | | |
|---|---|---|---|---|
| 5,965,847 | A * | 10/1999 | Tanaka | H01R 9/0527 174/84 R |
| 6,080,018 | A * | 6/2000 | Ferrill | H01R 9/035 439/607.47 |
| 6,776,196 | B2 * | 8/2004 | Yamakawa | H01R 43/05 140/71 R |
| 7,044,756 | B1 * | 5/2006 | Asakura | H01R 9/032 439/607.41 |
| 2002/0106918 | A1 * | 8/2002 | Saito | H01R 9/0524 439/98 |
| 2006/0128223 | A1 * | 6/2006 | Asakura | H01R 9/0512 174/78 |
| 2013/0068524 | A1 * | 3/2013 | Ito | H01R 9/0512 174/75 R |
| 2015/0004826 | A1 * | 1/2015 | Starke | H01R 4/64 439/345 |

FOREIGN PATENT DOCUMENTS

| | | | |
|---|---|---|---|
| DE | 102011056798 | A1 | 6/2013 |
| EP | 1168506 | A2 | 1/2002 |
| EP | 1237237 | A2 | 9/2002 |

* cited by examiner

*Primary Examiner* — Alexander Gilman

(74) *Attorney, Agent, or Firm* — Leydig, Voit & Mayer, Ltd

(57) ABSTRACT

A cable includes a connector and a lead. The lead has wires and a shield. The shield is folded over at one end of the lead so that, in a section, a first layer of the shield and a second layer of the shield are disposed at a radial offset to each other. A first crimped sleeve disposed in the section between the first layer and second layers of the shield. A second crimped sleeve disposed in the section radially outwardly with respect to the first and second layers of the shield.

9 Claims, 1 Drawing Sheet

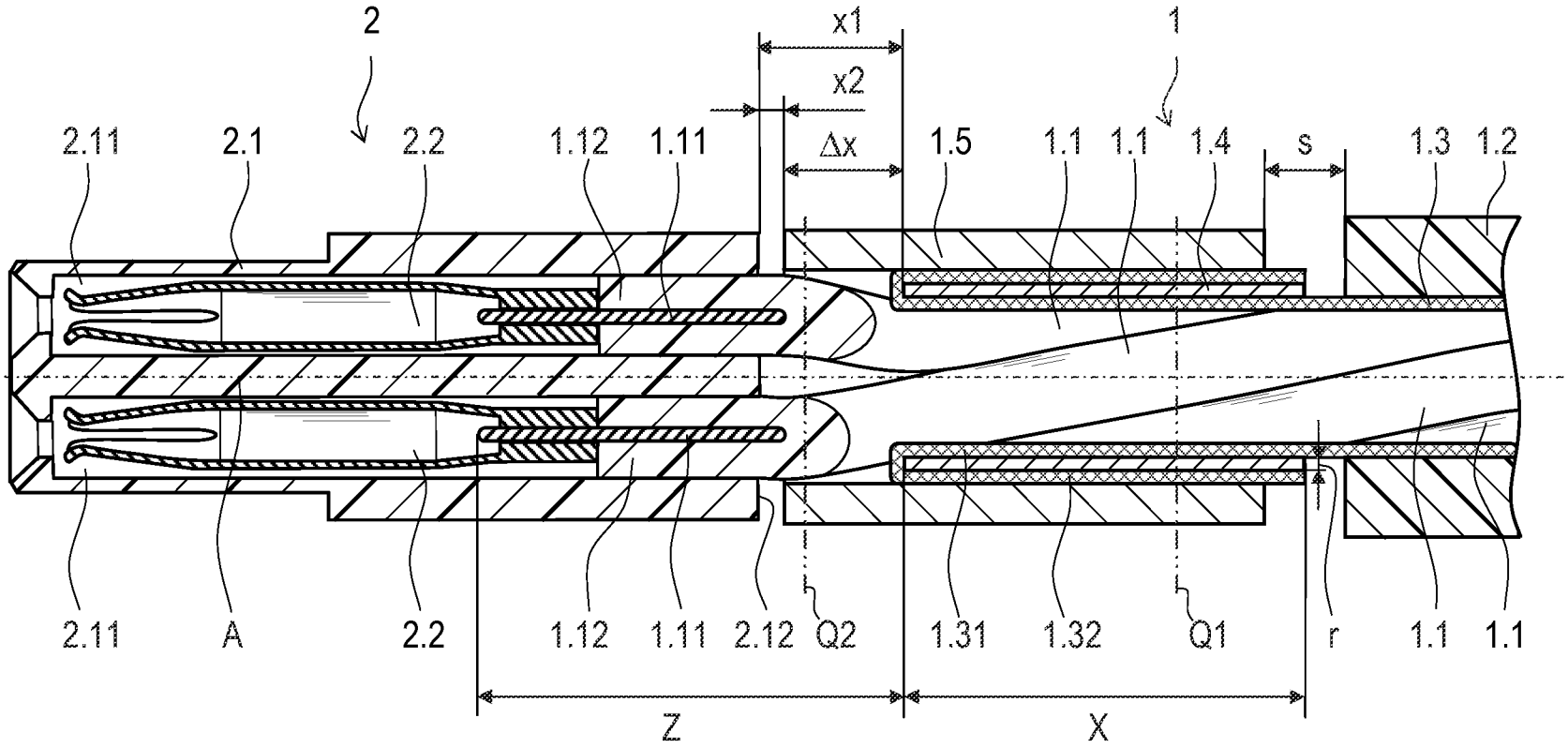
1.2
1.3
s
1.4
1
1.1
1.1
1.5
x1
x2
Δx
1.11
1.12
2.2
2
2.1
2.11
1.1
1.1
r
Q1
1.32
1.31
X
Q2
2.12
1.11
1.12
Z
2.2
A
2.11

MULTI-WIRE SHIELDED CABLE AND METHOD FOR MANUFACTURING SUCH A CABLE

CROSS-REFERENCE TO PRIOR APPLICATION

Priority is claimed to European Patent Application No. EP 14 003 808.4, filed on Nov. 12, 2014, the entire disclosure of which is hereby incorporated by reference herein.

FIELD

The present invention relates to a cable assembly which includes, in particular, a connector or coupling element and is used for transmitting electrical signals or voltages, as well as to a method for manufacturing such a cable.

Such cables can be used in motor vehicles or aircrafts, for example, and are frequently required in large quantities. Simple construction and simple preassembly are important factors in the economic supply of corresponding cables. Such cables must be manufactured with high process reliability and high precision, such as is required for high-quality signal transmission, for example. In addition, such cables must be well shielded electromagnetically so that no emitted electromagnetic waves can cause problems in the on-board electronics of the respective vehicle, for example. Furthermore, such cables must often be produced such that they can be used to transmit signals of relatively high frequency, as required for high-quality video signal transmission, for example.

BACKGROUND

German Laid Open Application DE 10 2011 056 798 A1 describes a cable having a multi-wire lead and a connector, as well as a shield. In accordance with DE 10 2011 056 798 A1, a spring element is placed on the shield. Then, a shield sleeve is compressed around this assembly to ensure the shielding property.

Although this cable design eliminates the need to cut the shield after the lead is cut to length during the actual assembly of the cable, the design set forth in DE 10 2011 056 798 A1 is nevertheless relatively complex.

SUMMARY

In an embodiment, the present invention provides a cable having a connector and a lead. The lead has a plurality of wires and a shield. The shield is folded over at one end of the lead so that, in a section, a first layer of the shield and a second layer of the shield are disposed at a radial offset to each other. A first crimped sleeve disposed in the section between the first layer and second layers of the shield. A second crimped sleeve disposed in the section radially outwardly with respect to the first and second layers of the shield.

BRIEF DESCRIPTION OF THE DRAWING

The present invention will be described in even greater detail below based on the exemplary figure. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawing which illustrates the following:

FIG. 1 is a longitudinal section through a cable.

DETAILED DESCRIPTION

In an embodiment, the present invention provides a cable which is of high quality yet producible with relatively little manufacturing effort.

In another embodiment, the present invention provides a manufacturing process that allows high-quality cables to be produced with relatively little effort.

In accordance with an embodiment, the cable includes a lead and a connector. The lead has a plurality of wires and a shield. At one end of the lead, the shield is folded over so that, in a section, a first layer of the shield and a second layer of the shield are disposed at a radial offset to each other. Within the section, a first crimped sleeve is disposed between the first and second layers of the shield. In addition, a second crimped sleeve is disposed radially outwardly with respect to the first and second layers of the shield within the section.

The cable has a longitudinal axis. Accordingly, the above-described section may be understood to be a cable portion extending along the longitudinal axis or an axial portion of the cable. The term "radial" will hereinafter refer, in particular, to a direction perpendicular to the longitudinal axis.

Preferably, a wire includes a conductor surrounded by an insulation or insulation layer The lead may in particular have a jacket which is removed along the section, the first layer of the shield and the second layer of the shield being disposed at a radial offset from one another within the section. In the terminology of the field, the term "stripping" is often used in this context, so that the respective end of the lead, respectively the section, may also be referred to as "stripped." Advantageously, the cable is in particular configured such that the section within which the first crimped sleeve is disposed is located in the stripped region of the cable. Accordingly, advantageously, the first crimped sleeve does not surround the jacket, but does surround the wires.

In an advantageous construction, the cable is configured such that the first crimped sleeve is disposed at an axial offset; i.e., an offset in the direction of the longitudinal axis, relative to the second crimped sleeve.

In a further embodiment of the present invention, contacts are attached to the ends of the wires, the contacts being received by a contact holder or insulative body, and the axial distance between the second crimped sleeve and the contact holder being smaller than the axial distance between the first crimped sleeve and the contact holder. Here, too, the term "axial" is understood to mean a direction along the longitudinal axis.

The contact holder advantageously has pass-through openings, the pass-through openings being arranged inside the contact holder and oriented parallel to the longitudinal axis. Accordingly, the contacts are received in the pass-through openings in such a way that they are disposed in the contact holder with a directional component that is oriented parallel to the longitudinal axis.

The contacts are electrically conductive end pieces of the wires or conductors and may be configured as pins or sockets.

Advantageously, the first crimped sleeve and the second crimped sleeve are made of electrically conductive material, and both crimped sleeves are electrically contacted to the shield.

In an advantageous construction, the wires each include a conductor, and the shield is cut to length such that in the non-folded over state, the shield would extend up to the end of at least one of the wires (in particular up to the end of the conductor of the respective wire). Thus, the extended shield is not shorter than the wires, in particular not shorter than the conductors of the wires.

The first crimped sleeve has a wall thickness, and the second layer of the shield is disposed at a radial offset relative to the first layer within the section, the magnitude of the radial offset being equivalent to the wall thickness. This results particularly from the fact that the first sleeve is crimped onto the first layer of the shield and the second sleeve is crimped directly onto the second layer of the shield. The crimping process used for attaching and electrically contacting the second sleeve provides high-quality electrical contacting between the shield, the first crimped sleeve and the second crimped sleeve.

In a further embodiment of the present invention, the lead has a jacket, which is removed at one end from the lead. In other words, the lead is stripped at the end. The second crimped sleeve is disposed such that a gap is present between the second crimped sleeve and the jacket. In particular, the gap is present between an end face of the second crimped sleeve and an end face of the jacket that is created after removal of the end of the jacket.

In a further embodiment of the present invention, the contacts are connected to the wires, in particular to the conductors of the wires, by crimping.

In accordance with an embodiment of the present invention, a method for manufacturing a cable having a connector includes the following steps:

providing a lead including a plurality of wires, a shield, and a jacket, removing the jacket at one end of the lead so that the shield is exposed there, placing a first sleeve radially outwardly of the exposed shield and press-fitting the first sleeve so that the first sleeve is fixedly secured on the shield, folding over the (exposed) shield around the first sleeve so that the first sleeve is located radially between a first and second layer of the shield within a section, attaching contacts to the ends of the wires and inserting the contacts into a contact holder, placing a second sleeve radially outwardly with respect to the first and second layers of the shield and press-fitting the second sleeve such that the second sleeve is fixedly secured on the shield at a predetermined distance from the contact holder.

Advantageously, a reference point or reference surface of the contact holder is used as a reference to maintain the distance between the second sleeve and the contact holder.

In a further embodiment of the present invention, contacts are attached to the ends of the wires, in particular by a crimping process, prior to press-fitting the second sleeve.

In an embodiment of the present invention, the contacts are inserted into the contact holder prior to press-fitting the second sleeve.

Other details and advantages of the cable and manufacturing method according to the present invention will be apparent from the following description of an exemplary embodiment, taken in conjunction with the accompanying drawing.

FIG. 1 shows a longitudinal section through a cable for transmitting signals, which is intended for installation in a vehicle. The cable includes a lead 1 (only partially shown in the figure) and a connector 2 or coupling element, so that the cable is detachably connectable by connector 2 at one end to a corresponding mating part of another component, such as, for example, an element of an on-board electronic system, in the manner of a plug-and-socket connection. The other end of the cable may also be provided with a coupling element. The extended cable has a longitudinal axis A.

In the exemplary embodiment presented here, cable 1 has four wires 1.1. Wires 1.1 each include a conductor 1.11, which may, for example, be in the form of a plurality of strands and is surrounded by an insulation layer 1.12. Accordingly, in the exemplary embodiment presented here, wires 1.1 may also be referred to as stranded conductors. Lead 1 further includes a shield 1.3, which here is made of wire mesh and surrounds wires 1.1. Disposed radially outwardly of shield 1.3 is an insulating jacket 1.2, which surrounds shield 1.3.

During manufacture of the cable, first such a lead 1 is provided. Lead 1 is cut, so that a first cut surface is produced at the cut end of lead 1, the wires 1.1, shield 1.3 and jacket 1.2 being of identical length; i.e., flush with one another.

Next, jacket 1.2 is slit along a circumferential line at the end of lead 1. Then, the end portion of jacket 1.2 is pulled off or removed. This step is performed such that afterwards shield 1.3 is exposed at the respective end of lead 1. At the end of lead 1, wires 1.1 and shield 1.3 are then still flush with one another, while jacket is 1.2 is shortened.

Subsequently, a first sleeve 1.4 is placed around shield 1.3 at a predetermined distance Z from the end face of lead 1 (i.e., from the first cut surface). First sleeve 1.4 may be configured as an open or closed sleeve 1.4, in particular as an open or closed crimp barrel as defined in DIN EN 60352-2. In the exemplary embodiment presented here, first sleeve 1.4 is made of electrically conductive material. First sleeve 1.4 is then press-fitted or crimped so that first sleeve 1.4 is fixedly secured on shield 1.3 radially outwardly of the exposed shield 1.3. Moreover, first sleeve 1.4 has a wall thickness r.

Then, the exposed shield 1.3; i.e., the end of shield 1.3 projecting from first sleeve 1.4 toward the end of lead 1, is folded over. Accordingly, first sleeve 1.4 is then disposed between a first layer 1.31 and a second layer 1.32 of shield 1.3 within an axial section X extending along longitudinal axis A. First layer 1.31 of shield 1.3 is located radially further inwardly relative to second layer 1.32 of shield 1.3. Consequently, first layer 1.31 and second layer 1.32 are disposed at a radial offset to each other. Since both layers 1.31, 1.32 of shield 1.3 directly contact sleeve 1.4, the radial offset is equal to wall thickness r of first sleeve 1.4. In addition, a good electrical contact is created between shield 1.3 and sleeve 1.4 by this configuration.

In the exemplary embodiment presented here, no further cutting of shield 1.3 is necessary during further processing. In other words, shield 1.3 is of such a length that in the non-folded over state, shield 1.3 would extend up to the end of at least one of the wires 1.1. In the exemplary embodiment presented in FIG. 1, length L of the exposed shield (which corresponds to the stripping length) is, in a first approximation, $L=X+r+Z$. The elimination of the need to cut shield 1.3 separately during processing is extremely advantageous because it prevents the risk of disturbing segments of shield 1.3 falling into the processing machine. In the case of shields 1.3 made of wire mesh, such disturbing segments may, in particular, be wires.

Next, insulation layers 1.12 at the ends of wires 1.1 are slit along a circumferential line and removed in this end region. Then, contacts 2.2 are attached to the lead 1 prepared in this manner. In particular, a contact 2.2 is fixed on each of the stripped ends of wires 1.1; i.e., on each of conductors 1.11, here by a crimping process. Then, contacts 2.2 are inserted into a dielectric (i.e., electrically insulating) contact holder 2.1, particularly into pass-through openings 2.11 of contact holder 2.1. In this phase of assembly of the cable, contact holder 2.1 is non-displaceably fixed on lead 1, for example by providing an interference fit. Furthermore, contact holder 2.1 has an end face 2.12, which is located opposite the end of contact holder 2.1 that serves for electrical coupling. In the exemplary embodiment presented here, contact holder 2.1 is formed as a single piece. Thus, connector 2 includes contact holder 2.1 and contacts 2.2 disposed therein.

Subsequently, a second sleeve 1.5 is placed around second layer 1.32 of shield 1.3. Second sleeve 1.5 may also be configured as an open or closed sleeve 1.5, in particular as an open or closed crimp barrel as defined in DIN EN 60352-2. In the exemplary embodiment presented here, second sleeve 1.5 is also made of electrically conductive material.

To enable simple and accurate axial positioning of second sleeve 1.5, end face 2.12 of contact holder 2.1 is used as a reference so that second sleeve 1.5 is positioned at a distance x2 from end face 2.12. In this way, distance x2 between second sleeve 1.5 and contact holder 2.1, which is important to the function of the cable, can be maintained in a simple but accurate manner. The axial extent of second sleeve 1.5 is sized such that a gap s is present between the end face of jacket 1.2 and second sleeve 1.5. In this way, it is possible to ensure the axial play required to accurately position second sleeve 1.5 relative to the contact holder. On the other hand, sufficient shielding is ensured across gap s because the intact shield 1.3 is disposed around wires 1.1 there. Moreover, wires 1.1 are at least partially shielded in gap s also by first sleeve 1.4 and second layer 1.32 of shield 1.3.

Then, second sleeve 1.5 is press-fitted or crimped so that second sleeve 1.5 is fixedly secured on shield 1.3 at a predetermined distance x2 from contact holder 2.1.

As shown in FIG. 1, first crimped sleeve 1.4 is now located between first and second layers 1.31, 1.32 of shield 1.3. Furthermore, second crimped sleeve 1.5 is disposed radially outwardly with respect to first and second layers 1.31, 1.32 of shield 1.3.

Axial distance x2 between second crimped sleeve 1.5 and contact holder 2.1 is smaller than axial distance xl between first crimped sleeve 1.4 and contact holder 2.1. Accordingly, first crimped sleeve 1.4 is disposed at an axial offset $\Delta x$ ($\Delta x = x1 - x2$) relative to second crimped sleeve 1.5.

The cable is configured such that, in a radial direction from the inside to the outside within a first cross section Q1 through the cable, there are disposed first the wires 1.1, first layer 1.31 of shield 1.3, first crimped sleeve 1.4, second layer 1.32 of shield 1.3, and finally second crimped sleeve 1.5. In a second cross section Q2 through the cable, which is axially offset from first cross section Q1 toward contact holder 2.1, there are disposed, in a radial direction from the inside to the outside, first the wires 1.1 and, immediately adjacent thereto, only second crimped sleeve 1.5.

The respective cable has excellent shielding properties. In addition, shield 1.3 is reliably held together by second sleeve 1.5, so that no pieces or wires of shield 1.3 can project and possibly cause injuries or otherwise interfere with the processing of the cable.

In the exemplary embodiment presented here, in addition, a housing or electrically conductive outer sleeve is disposed around the end of the cable.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A cable comprising:

a connector;

a lead having a plurality of wires and a shield, contacts being attached to ends of the wires, the contacts being received by a contact holder, the shield being folded over at one end of the lead so that, in a section, a first layer of the shield and a second layer of the shield are disposed at a radial offset to each other;

a first crimped sleeve disposed in the section between the first layer and second layers of the shield; and a second crimped sleeve disposed in the section radially outwardly with respect to the first and second layers of the shield, wherein the first crimped sleeve is disposed at an axial offset relative to the second crimped sleeve such that an axial distance between the second crimped sleeve and the contact holder is smaller than an axial distance between the first crimped sleeve and the contact holder, and wherein a wall thickness of the first crimped sleeve corresponds to the radial offset between the first and second layers of the shield.

2. The cable as recited in claim 1, wherein the first crimped sleeve and the second crimped sleeve are made of electrically conductive material, and are electrically contacted to the shield.

3. The cable as recited in claim 1, wherein the lead includes a jacket which is not present along the section.

4. The cable as recited in claim 1, wherein the wires each include a conductor, and wherein the shield is cut to length such that, in a non-folded over state, the shield extends up to an end of at least one of the conductors.

5. The cable as recited in claim 1, wherein the lead has a jacket which is not present at one end from the lead, and wherein the second crimped sleeve is disposed such that a gap is present between the second crimped sleeve and the jacket.

6. A method for manufacturing a cable having a connector, the method comprising:

providing a lead including a plurality of wires, a shield, and a jacket;

removing the jacket at one end of the lead so that the shield is exposed;

placing a first sleeve radially outwardly of the exposed shield and press-fitting the first sleeve so that the first sleeve is fixedly secured on the shield;

folding over the shield around the first sleeve so that the first sleeve is located, within a section, radially between a first layer and a second layer of the shield;

attaching contacts to the ends of the wires and inserting the contacts into a contact holder; and subsequently placing a second sleeve radially outwardly with respect to the first and second layers of the shield and press-fitting the second sleeve such that the second sleeve is fixedly secured on the shield at a predetermined distance from the contact holder wherein the second sleeve is placed such that an axial distance between the second sleeve and the contact holder is smaller than an axial distance between the first sleeve and the contact holder.

7. The method as recited in claim 6, wherein a reference point or reference surface of the contact holder is used as a reference to maintain the predetermined distance between the second sleeve and the contact holder.

8. The method as recited in claim 6, wherein the second sleeve is placed such that an end of the second sleeve facing the contact holder is axially offset relative to an end of the first sleeve facing the contact holder.

9. The method as recited in claim 6, wherein a wall thickness of the first sleeve corresponds to a radial offset between the first and second layers of the shield.

* * * * *